US009426549B2

(12) United States Patent
Cheung

(10) Patent No.: US 9,426,549 B2
(45) **Date of Patent: *Aug. 23, 2016**

(54) FLAT PANEL LOUDSPEAKER SYSTEM AND METHOD OF MAKING

(71) Applicant: The Boeing Company, Chicago, IL (US)

(72) Inventor: Wing W. Cheung, Shoreline, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/835,421

(22) Filed: Aug. 25, 2015

(65) Prior Publication Data

US 2015/0365746 A1 Dec. 17, 2015

Related U.S. Application Data

(63) Continuation of application No. 13/929,073, filed on Jun. 27, 2013, now Pat. No. 9,154,862.

(51) Int. Cl.

| | |
|---|---|
| ***H04R 25/00*** | (2006.01) |
| ***H04R 1/02*** | (2006.01) |
| ***H04R 7/10*** | (2006.01) |
| *H04R 7/04* | (2006.01) |

(52) U.S. Cl.

CPC .. *H04R 1/02* (2013.01); *H04R 7/10* (2013.01); *H04R 7/045* (2013.01); *H04R 2440/05* (2013.01); *H04R 2499/13* (2013.01)

(58) Field of Classification Search

CPC ..... H04R 7/04; H04R 7/045; H04R 2440/05
See application file for complete search history.

(56) References Cited

U.S. PATENT DOCUMENTS

| | | | |
|---|---|---|---|
| 4,322,583 | A | 3/1982 | Maeda |
| 4,514,599 | A | 4/1985 | Yanagishima et al. |
| 4,551,849 | A | 11/1985 | Kasai et al. |
| 4,566,120 | A | 1/1986 | Nieuwendijk et al. |
| 4,586,192 | A | 4/1986 | Arntson |
| 4,897,877 | A | 1/1990 | Tetzlaff |

(Continued)

FOREIGN PATENT DOCUMENTS

| | | |
|---|---|---|
| WO | 92/03024 | 2/1992 |
| WO | 97/09858 | 3/1997 |
| WO | 98/26630 | 6/1998 |

OTHER PUBLICATIONS

EP, Search Report and Opinion, European Application No. 14172687.7 (Nov. 17, 2014).

(Continued)

*Primary Examiner* — Curtis Kuntz
*Assistant Examiner* — Ryan Robinson
(74) *Attorney, Agent, or Firm* — Thompson Hine LLP

(57) ABSTRACT

An exciter assembly for use with a flat panel loudspeaker system including a panel having a core, an inner sheet coupled to an inner surface of the core and an outer sheet coupled to an outer surface of the core. The exciter assembly may include an exciter having a voice coil assembly attachable to the outer sheet of the panel, the voice coil assembly having a lock pad, and a lock base releasably engaging the lock pad and attachable to the outer sheet of the panel, to vibrate the panel to generate sound energy; and an exciter support bracket connected to the exciter housing and attachable to the outer sheet of the panel.

20 Claims, 7 Drawing Sheets

(56) References Cited

U.S. PATENT DOCUMENTS 5,212,732 A 5/1993 Hipps et al.
5,699,438 A 12/1997 Smith et al.
5,708,719 A 1/1998 Greenberger et al.
6,031,926 A 2/2000 Azima et al.
6,058,196 A 5/2000 Heron
6,144,746 A 11/2000 Azima et al.
6,188,775 B1 2/2001 Azima et al.
6,198,831 B1 3/2001 Azima et al.
6,215,882 B1 4/2001 Heron
6,237,715 B1 5/2001 Tracy
6,247,551 B1 6/2001 Heron
6,275,598 B1 * 8/2001 Bachmann ..... H04R 7/045 181/167
6,304,661 B1 10/2001 Azima et al.
6,320,967 B1 11/2001 Azima et al.
6,327,369 B1 12/2001 Azima et al.
6,332,029 B1 12/2001 Azima et al.
6,377,695 B1 4/2002 Azima et al.
6,442,282 B2 8/2002 Azima et al.
6,478,109 B1 11/2002 Kam
6,494,289 B1 * 12/2002 Bachmann ..... H04R 7/045 181/151
6,519,347 B1 2/2003 Morecroft et al.
6,519,349 B1 2/2003 Azima et al.
6,681,026 B2 1/2004 Kam
6,782,111 B1 8/2004 Wagner et al.
6,826,285 B2 11/2004 Azima
7,088,836 B1 8/2006 Bachmann et al.
7,194,098 B2 * 3/2007 Azima ..... B42D 15/022 381/152
7,218,745 B2 * 5/2007 McConnell ..... B60R 11/0235 381/152
7,236,601 B1 6/2007 Bachmann et al.
7,283,637 B2 10/2007 Suzuki et al.
7,372,968 B2 * 5/2008 Buos ..... H04R 9/066 381/152
7,440,582 B2 * 10/2008 Hager ..... B60R 11/0223 181/199
7,447,322 B2 11/2008 Harris, Jr. et al.
7,817,810 B2 * 10/2010 Cheung ..... H04R 7/045 244/118.5
8,139,795 B2 3/2012 Scheel et al.
8,165,336 B2 4/2012 Iino et al.
8,180,065 B2 5/2012 Snider
8,223,987 B2 * 7/2012 Shibata ..... B60R 11/0223 181/150
8,247,930 B2 * 8/2012 Yamagishi ..... H04R 9/066 310/12.16
2002/0018575 A1 2/2002 Bream
2002/0141607 A1 10/2002 Azima et al.
2004/0129492 A1 7/2004 Bertagni et al.
2006/0110001 A1 * 5/2006 Saint Vincent ..... H04R 7/20 381/396
2007/0261912 A1 11/2007 Langberg
2008/0089537 A1 4/2008 Scheel et al.
2011/0135141 A1 6/2011 Tanabe
2015/0373458 A1 * 12/2015 Newlove ..... H02K 41/0356 381/400

OTHER PUBLICATIONS

US, Non-Final Office Action, U.S. Appl. No. 13/929,073 (Sep. 11, 2014).
US, Final Office Action, U.S. Appl. No. 13/929,073 (Mar. 20, 2015).
US, Notice of Allowance, U.S. Appl. No. 13/929,073 (May 27, 2015).

* cited by examiner

FLAT PANEL LOUDSPEAKER SYSTEM AND METHOD OF MAKING

TECHNICAL FIELD

The disclosure relates to a loudspeaker system, and more particularly, to loudspeaker systems mounted in wall panels.

BACKGROUND

Vehicles, such as aircraft, include passenger cabins and other compartments enclosed at least partially by lightweight panels. It is necessary for the pilot of such vehicles to communicate with the passengers in the passenger cabin of such vehicles, and therefore such cabins require speaker systems to transmit the pilot's voice, as well as other informational messages, music, motion picture soundtracks and the like.

Traditionally, cone speakers are used as part of a loudspeaker system. Such cone speakers include a driver having a cone driven by a voice coil. Such cone speakers typically are mounted above a ceiling panel over passenger seats in a vehicle. A disadvantage with such cone speakers is that the cone component takes up valuable space above the ceiling panel. Another disadvantage is that it is necessary to cut a hole through the ceiling panel to allow the sound energy generated by the cone to pass through the ceiling panel. In addition, cone speakers project sound at a relatively narrow dispersion angle (±30 degrees). Therefore, for short distance sound projection, such as in an aircraft or other vehicle cabin environment, many cone speakers must be used, and spaced to cover the entire passenger cabin area.

The disadvantages of cone speakers with respect to space, narrow sound projection, and the necessity of cutting a hole through the panel may be overcome by using a flat panel speaker. Currently, there are two types of flat panel speakers: electrostatic speakers and electromagnetic induction (EMI) speakers. However, a disadvantage with electrostatic speakers is that they are dipole, and therefore require openings in both the front and back, and require a thin, soft film diaphragm that is too fragile for use in, for example, an aircraft cabin due to pressure changes during a flight. Electrostatic speakers are coherence speakers and are very directional—making them a poor choice for short distance sound coverage. Further, electrostatic speakers require high voltage—on the order of 2,000 volts—and require heavy metal core transformers. All of this is undesirable for use in applications such as an aircraft cabin. A disadvantage with EMI speakers is that they require a relatively heavy magnetic bar and a printed or wired coil diaphragm. The magnetic bar adds weight to the aircraft. Magnetic field radiation is prohibited for plane use, and the diaphragm, which also must work on dipole principle, is too fragile for use in environments such as an aircraft cabin, and is a coherence speaker, having a projection angle narrower than that of a cone speaker.

Accordingly, there is a need for a loudspeaker system that may take up less space than a conventional cone speaker, not require cutting a hole through a passenger compartment panel, and that is able to project sound over a wider area than current loudspeaker systems.

SUMMARY

The present disclosure describes a flat panel loudspeaker system that, in aspects, is relatively compact, does not require cutting a hole through a passenger compartment panel, and projects sound over a wider area than current loudspeaker systems. In one aspect, an exciter assembly is for use with a flat panel loudspeaker system including a panel having a core, an inner sheet coupled to an inner surface of the core and an outer sheet coupled to an outer surface of the core. The exciter assembly may include an exciter having an exciter housing, a voice coil assembly attachable to the outer sheet of the panel, the voice coil assembly having a lock pad, and a lock base releasably engaging the lock pad and attachable to the outer sheet of the panel, to vibrate the panel to generate sound energy; and an exciter support bracket connected to the exciter housing and attachable to the outer sheet of the panel.

In another aspect, a flat panel loudspeaker system for a vehicle may include a panel forming a cabin wall in a vehicle, the panel having a core, an inner sheet coupled to an inner surface of the core and an outer sheet coupled to an outer surface of the core; an exciter having an exciter housing, a voice coil assembly attached to the outer sheet of the panel, the voice coil assembly having a lock pad and a lock base releasably engaging the lock pad and mounted on and contacting the outer sheet of the panel, to vibrate the panel to generate sound energy within the vehicle; and an exciter support bracket connected to the exciter housing and attached to the outer sheet.

In yet another aspect, a method of constructing a flat panel loudspeaker system for transmitting sound energy within a vehicle cabin including a panel, the panel having a core, an inner sheet coupled to an inner surface of the core, and an outer sheet coupled to an outer surface of the core, may include attaching an exciter having an exciter housing, a voice coil assembly to the outer sheet of the panel, the voice coil assembly having a lock pad and a lock base, by attaching the lock pad to the outer sheet of the panel, and releasably attaching the lock pad the lock base, such that vibration of the exciter vibrates the panel to generate sound energy within the vehicle cabin; attaching an exciter support bracket to the outer sheet; and connecting the exciter support bracket to the exciter housing.

Other objects and advantages of the disclosed flat panel loudspeaker system and method of making will be apparent from the following description, the accompanying drawings and the appended claims.

DETAILED DESCRIPTION

Figure 1:
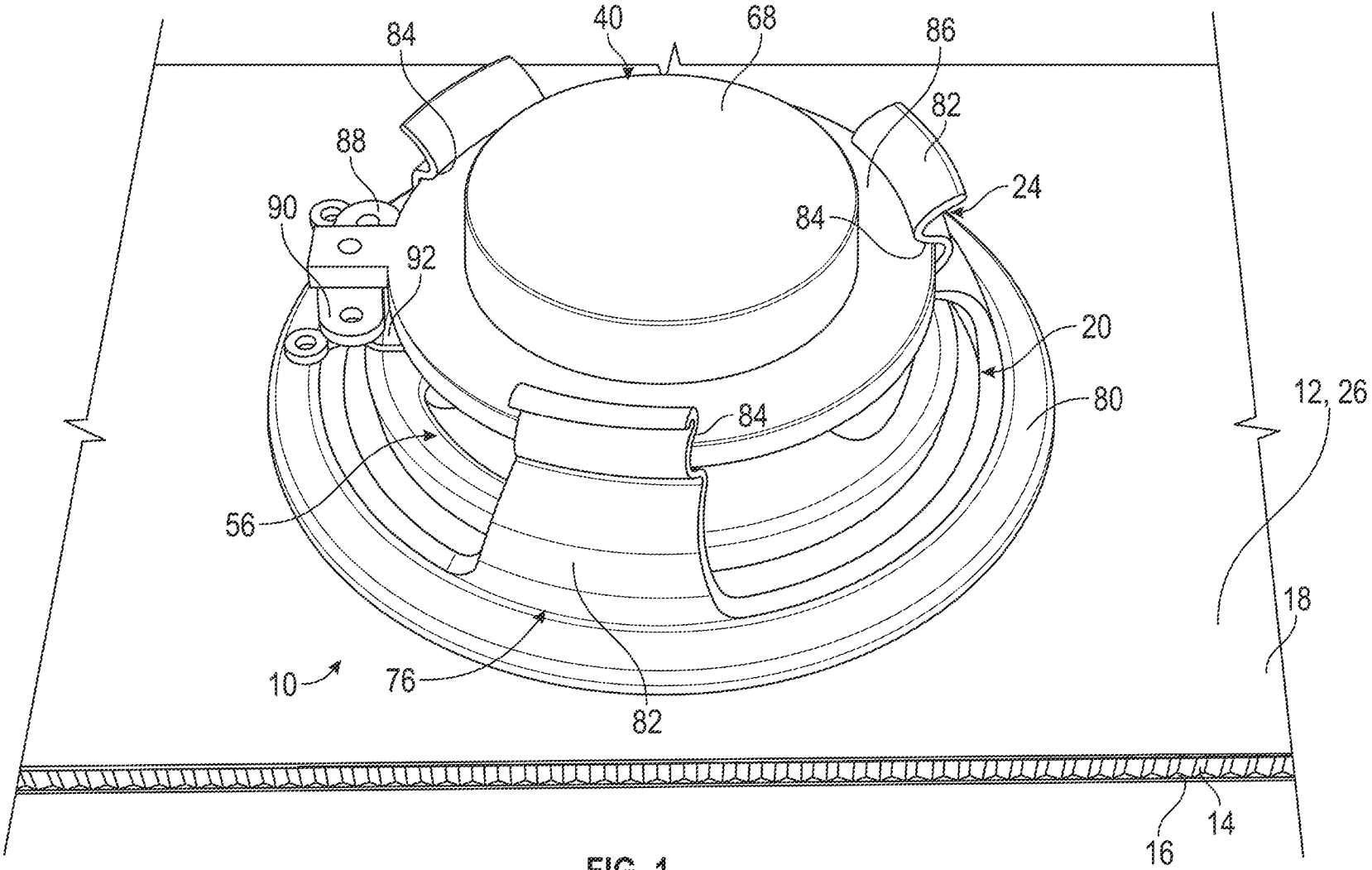
FIG. 1 is a perspective view of the disclosed flat panel loudspeaker system.
Figure 2:
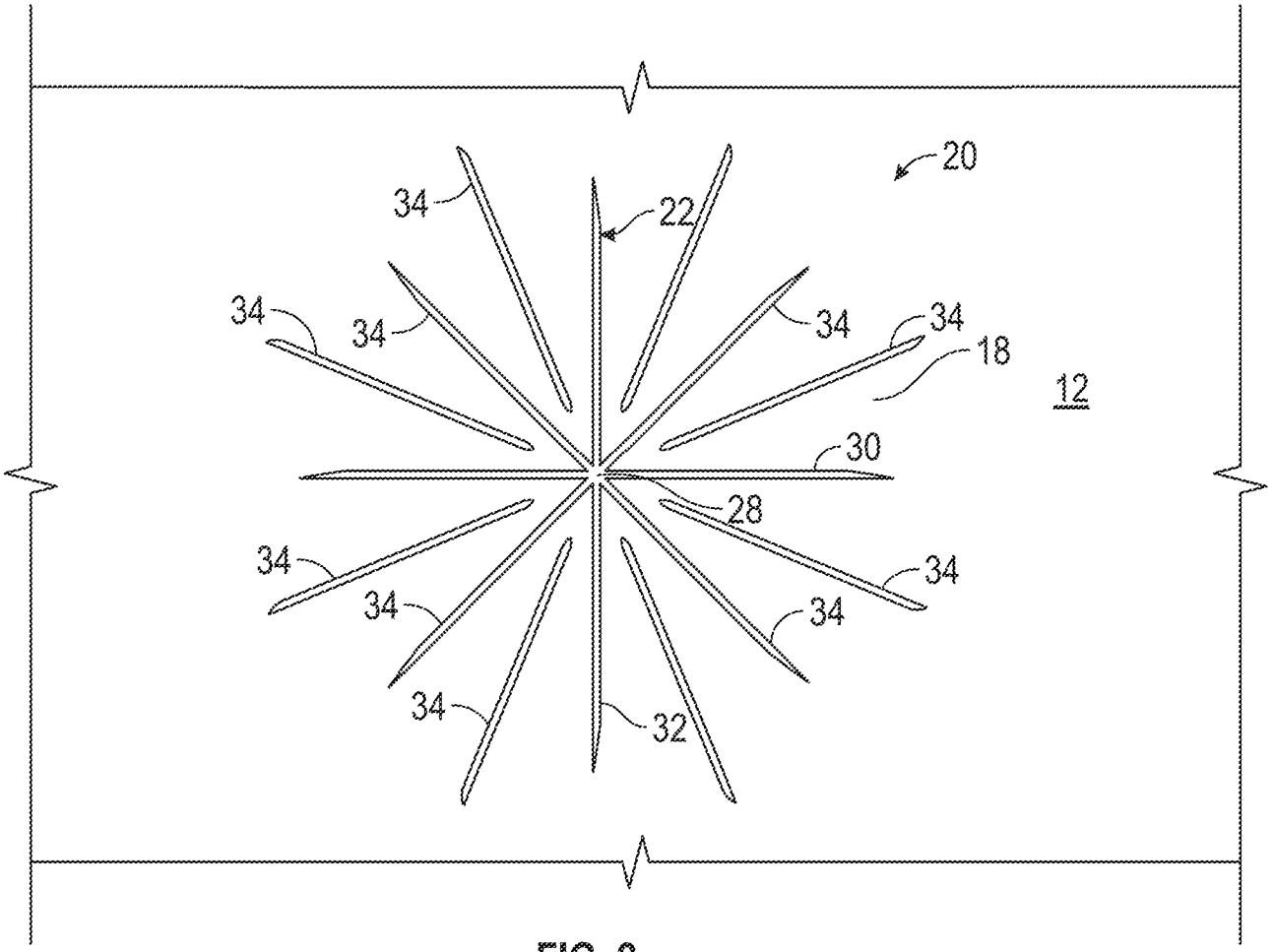
FIG. 2 is a plan view of the panel of the system of FIG. 1, showing the weakened area defined by at least one slot formed through the outer sheet of the panel.
Figure 3:
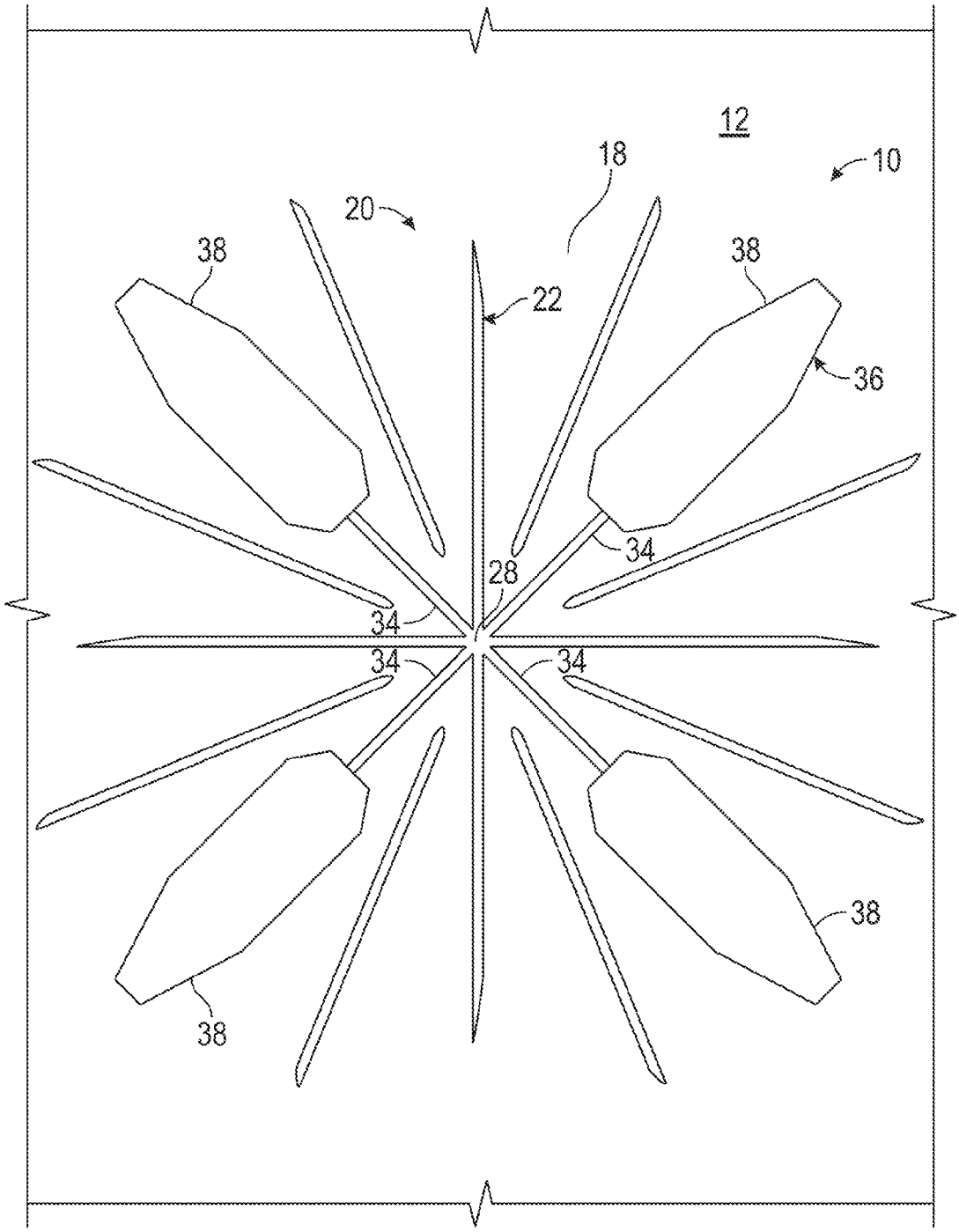
FIG. 3 is a plan view of the panel of FIG. 2, shown with damping elements in the form of segments of tape covering portions of the slots.

As shown in FIG. 1, a flat panel loudspeaker system, generally designated 10, may incorporate a panel 12 having a core 14, an inner sheet 16 coupled to an inner surface of the core 14, and an outer sheet 18 coupled to an outer surface of the core 14. As shown in FIGS. 2 and 3, the panel 12 may have a weakened area, generally designated 20, defined by at least one slot 22 formed through the outer sheet 18, thereby exposing the core 14. In other embodiments, the at least one slot 22 may be formed only partially through the outer sheet 18. As shown in FIG. 1, the loudspeaker system 10 may include an exciter, generally designated 24, attached to the panel 12 at the weakened area 20 and configured to vibrate the panel to generate sound energy. In an embodiment, the inner sheet 16 may be imperforate over the weakened area 20; that is, there may be no holes, slots or cuts formed in the inner sheet opposite the weakened area 20.

In an embodiment, the panel 12 may be a portion of a vehicle 26, such as an aircraft, a spacecraft, a land vehicle, a marine vehicle, and a submarine vehicle. In still other embodiments, the panel 12 may be used as part of a wall or ceiling of a building or other static structure. In an embodiment, the panel 12 may be a ceiling panel, or interior wall enclosing a passenger compartment of an aircraft. In an embodiment, the inner sheet 16 and outer sheet 18 may be made of fiberglass, and in other embodiments may be made of aluminum, KEVLAR (a trademark of E. I. du Pont de Nemours and Company of Wilmington, Del.), carbon fiber, composite or graphite. In an embodiment, the core 14 may be a honeycomb core or foam core, and may be made of fiberglass, aluminum or NOMEX (a trademark of E. I. du Pont de Nemours and Company of Wilmington, Del.). The panel 12 may be on the order of ⅜ inches to ¾ inches thick, or thicker if the size of the panel is expanded. In other embodiments, the panel 12 may be a sandwich panel having balsa wood/fiberglass resin skins coupled to a foam core 14. For domestic applications, the sandwich panel may be made of cardboard paper skins with a paper honeycomb core, thin metal, plastic or thin wood skins with a paper honeycomb or foam core, and the like. Core material may include balsa wood configured as many thin beams that cross to form a support structure or matrix, or large, open-cell plastic structure.

As shown in FIGS. 2 and 3, the at least one slot 22 may take the form of a plurality of slots extending generally radially from a center 28 of the weakened area 20. In an embodiment, the plurality of slots 22 may be evenly spaced about the center 28. In an embodiment, the slots 22 may include at least two pairs of slots 30, 32 arranged to intersect at a pre-set angle. In an embodiment, the pre-set angle may be a right angle. In an embodiment, the slots 22 may include a plurality of slots 34 positioned in between the intersecting slots 30, 32. However, any suitable configuration of slots (more or less, longer or shorter) to achieve the required audio performance may be employed. In embodiments, the slots 22 may be rectilinear, curvilinear, or combinations of both.

As shown in FIG. 3, in an embodiment, the loudspeaker system 10 may include a damping element, generally designated 36. The damping element 36 may be attached to the outer sheet 18 at the weakened area 20. In an embodiment, the damping element 36 may include tape 38 covering less than the entirety of at least one slot 34. In an embodiment, the tape 38 may be formed in segments, and the segments may be spaced evenly about the weakened area 20. In embodiments, the tape segments 38 may be made of vinyl, such as electrical tape, and in other embodiments, may be made of paper, such as masking tape. In yet another embodiment, the tape segments 38 may be an aluminum tape. In still other embodiments, other materials may be used. The tape segments 38 may be attached to the outer sheet 18 by a suitable adhesive.

Figure 4:
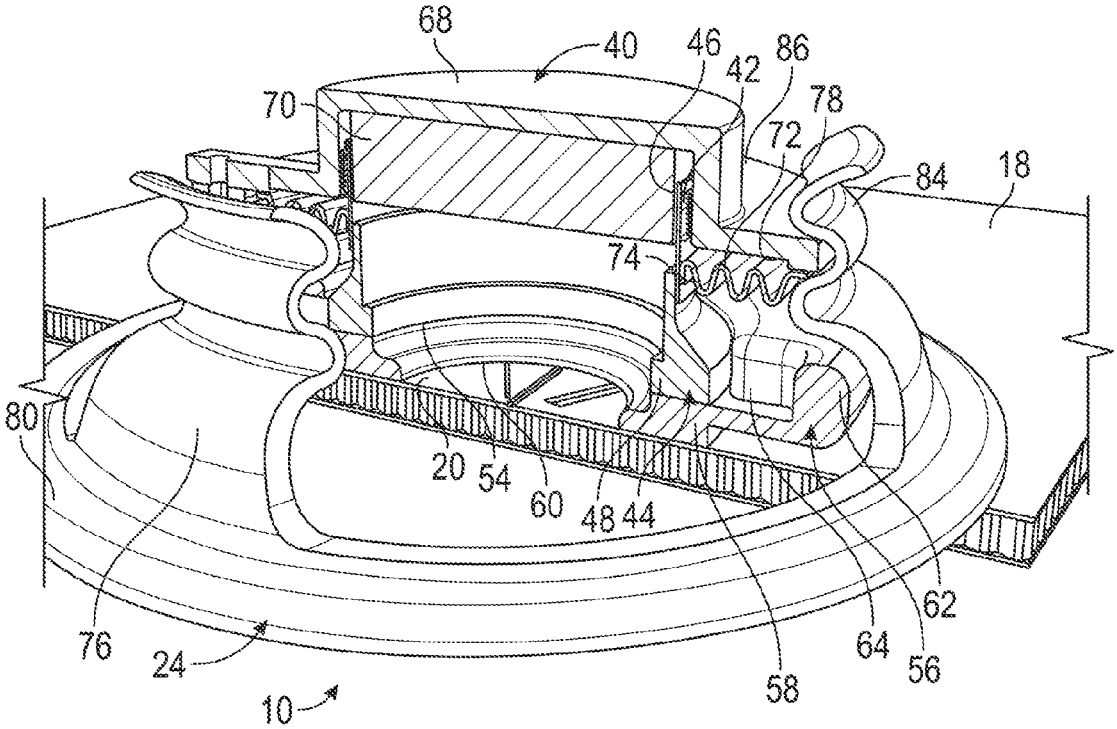
FIG. 4 is a perspective view of the flat panel loudspeaker system of FIG. 1, in which the panel and exciter are in section.
Figure 5:
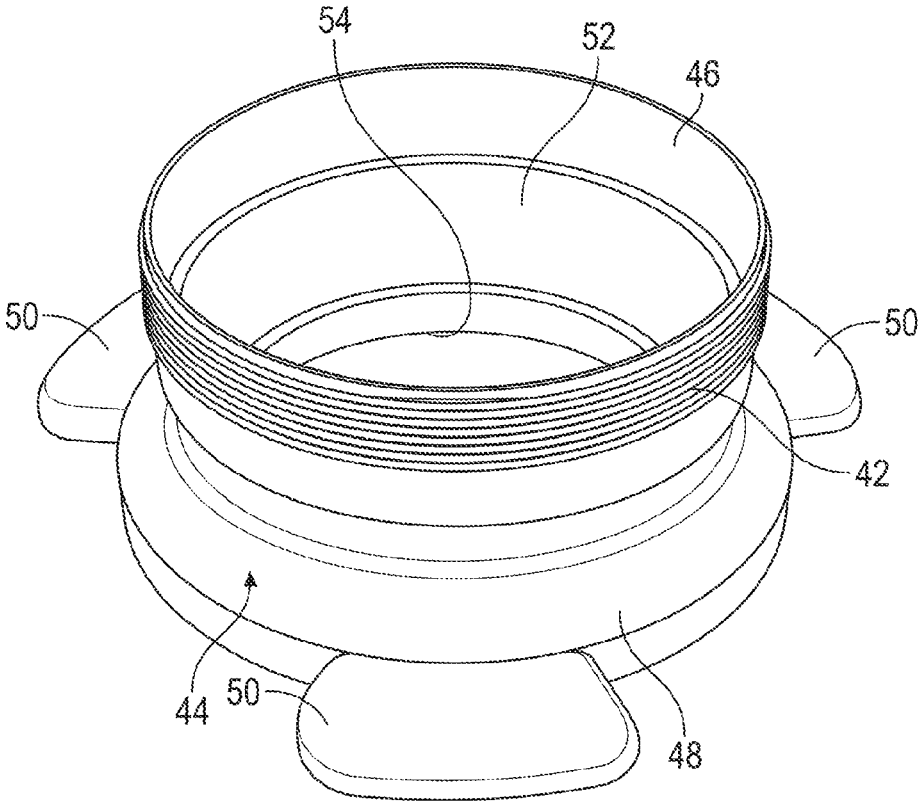
FIG. 5 is a perspective view of the coil, coil former and lock pad of the flat panel loudspeaker system of FIG. 1.

As shown in FIGS. 1 and 4, the exciter 24 may include a voice coil assembly, generally designated 40, attached to the outer sheet 18 at the weakened area 20. In an embodiment, the voice coil assembly 40 may include a coil 42 configured to be energized by an electric current, and a lock pad 44. The lock pad 44 may include a coil former 46, as shown in FIG. 5. In embodiments, the coil 42 may be made of thin gauge copper wire, or other conductive wire such as aluminum. The lock pad 44 may be made of plastic, nylon or other suitable solid, lightweight material, and the coil former 46 that may include the voice coil assembly 40, may be mounted above the lock pad 44, and may be made of KAPTON (a trademark of E. I. du Pont de Nemours and Company of Wilmington, Del.), plastic, nylon, stiff paper, or any suitable dielectric. The lock pad 44 may include a base 48 having radially projecting tabs 50. In an embodiment, the tabs 50 may be spaced evenly about the base 48. The coil former 46 may be cylindrical in shape and sized to slip over the outer surface of a cylindrical projection 52 of the lock pad 44 and secured to the cylindrical projection by a suitable adhesive. The cylindrical projection 52 and coil former 46 may be shaped to define an opening 54 centrally through the lock pad 44.

As shown in FIGS. 1, 4, and 6A and 6B, the exciter 24 may include a lock base 56 mounted on and contacting the outer sheet 18 of the panel 12, and configured to releasably engage the lock pad 44. The lock base 56 may include an annular base 58 that contacts the outer sheet 18 and that defines an opening 60 that may be coaxial with the opening 54 formed by the lock pad 44. The base 48 of the lock pad 44 may be shaped to align with the annular base 58 of the lock base 56 in an axial direction with respect to the openings 54, 60. The lock base 56 may include an outer flange 62 having slots 64 shaped to receive the tabs 50 of the lock pad 44. The slots 64 may include pockets 66 for securing the tabs 50 in a releasable friction fit, bayonet connection.

Figure 6B:
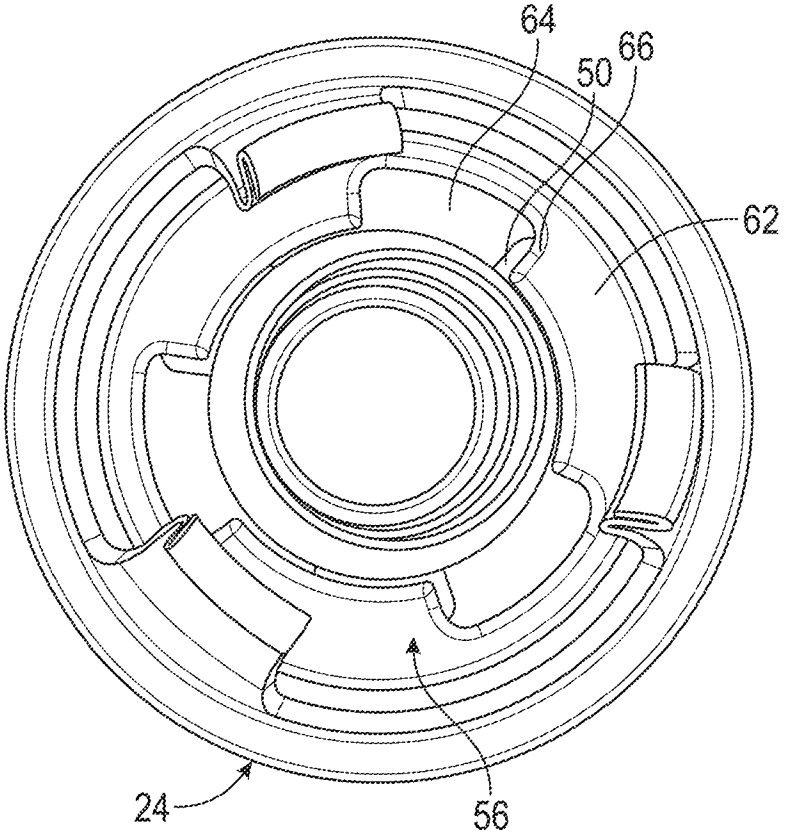
FIGS. 6A and 6B are plan views of the lock pad, lock base and support bracket, in which the lock pad is shown in an unlocked and a locked position, respectively.
Figure 6A:
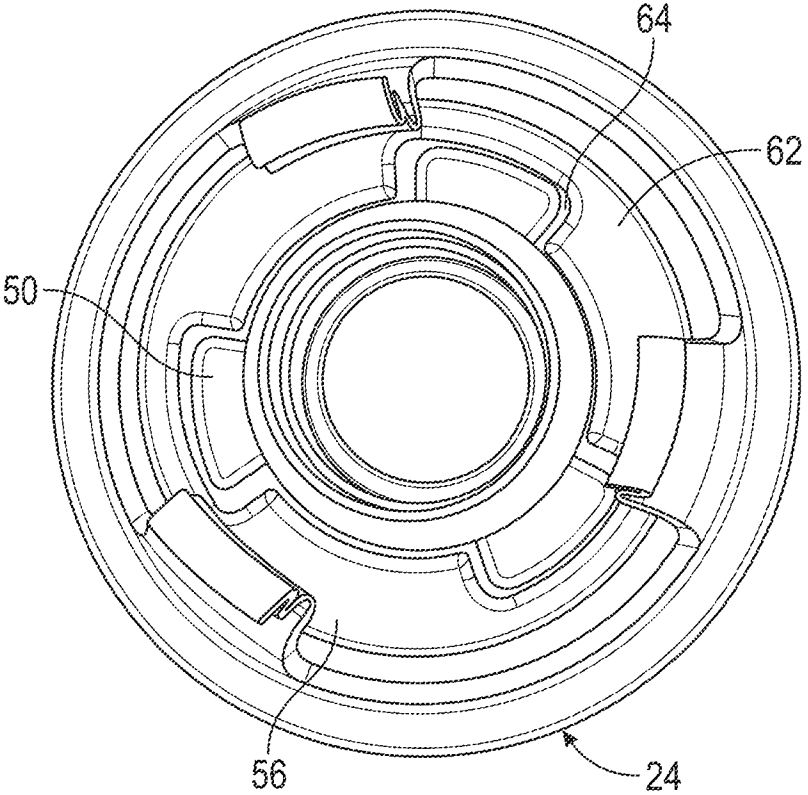

As shown best in FIGS. 6A and 6B, the lock pad 44 may be placed on the lock base 56 so that the tabs 50 may be centered in the slots 64. The lock pad 44 may then be rotated clockwise relative to the lock base 56, as shown in FIG. 6B, so that the tabs 50 engage the pockets 66 of the slots 64, thus securing the lock pad to the lock base. Thereafter, the lock pad 44 may be rotated in a counter-clockwise direction from the orientation in FIG. 6B to the orientation in FIG. 6A to release the engagement between the lock pad and the lock base 56.

Figure 6C:
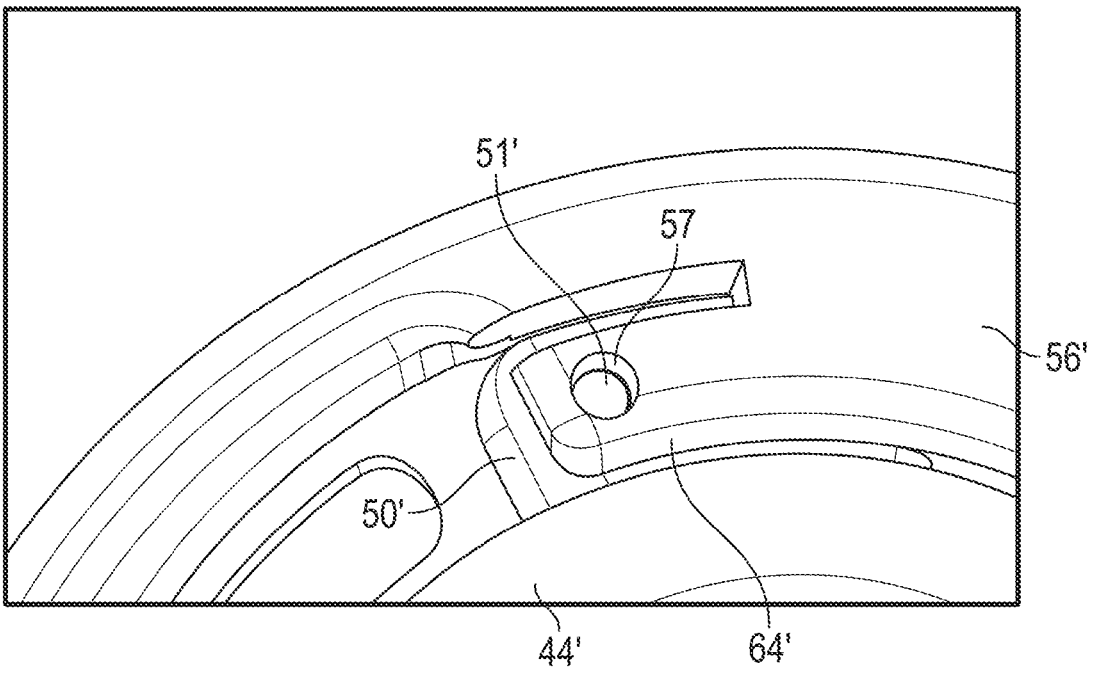
FIG. 6C is a detail in perspective showing an alternate engagement between the lock pad and lock base.

As shown in FIG. 6C, in an embodiment, the lock pad 44' may include one or more tabs 50' (only one of which is shown) that may have a raised locking detent 51 that is shaped and positioned on an upper surface of the tab to engage a correspondingly shaped catch, which in the embodiment shown is a hole 57 formed in the slot 64' of the lock base 56'. Other shapes of locking detent 51' may be employed without departing from the scope of the disclosed system 10. The use of a locking detent 51 and hole 57 may prevent inadvertent disengagement of the lock pad 44' from the lock base 56'.

As shown in FIGS. 1 and 4, the exciter 24 may include an exciter housing 68 shaped to receive a magnet 70, which in an embodiment may be a permanent magnet. The magnet 70 may be cylindrical in shape and concentric with the coil 42. The magnet 70 may extend from the exciter housing inside the coil former 46 to form a magnetic gap with the coil 42. The exciter housing 68 may be made of metal, such as steel, which may be part of the magnetic circuitry to redirect the magnetic field of the magnet 70 to the gap between the magnet and coil 42 to reduce flux leakage.

The exciter 24 also may include a suspension spring 72 that may be attached at an inner periphery to the coil former 46, and at an outer periphery to an annular flange 86 of the exciter housing 68. In embodiments, the attachment may be by a suitable adhesive. The suspension spring 72 may be made of a fabric, such as KEVLAR (a trademark of E. I. Du Pont de Nemours and Company). Thus, the suspension spring 72 may support the coil 42 and lock pad 44 and keep them centered relative to the exciter housing 68 and magnet 70.

An exciter support bracket 76 may be connected to the exciter housing 68, and include an annular base 80 that may be mounted on the outer sheet 18 of the panel 12. The base 80 may be attached to the outer sheet 18 by a suitable adhesive, or by mechanical means, such as screws, rivets or fasteners. The support bracket 76 may include resilient arms 82 projecting upwardly from the base 80 and spaced evenly about the periphery of the base. The arms 82 may be shaped to form arcuate slots 84 that may be biased radially inwardly to releasably receive the outer annular flange 86 of the exciter housing 68. As shown in FIG. 1, the flange 86 of the housing 68 may include tabs 88 to which a terminal 90 may be attached. Terminal 90 may serve as leads for the wires 92 (only one of which is shown) of the coil 42. The tabs 88, in conjunction with terminal 90, may be attached to audio equipment (not shown), such as an amplifier, to receive audio signals to drive the exciter 24.

Figure 7:
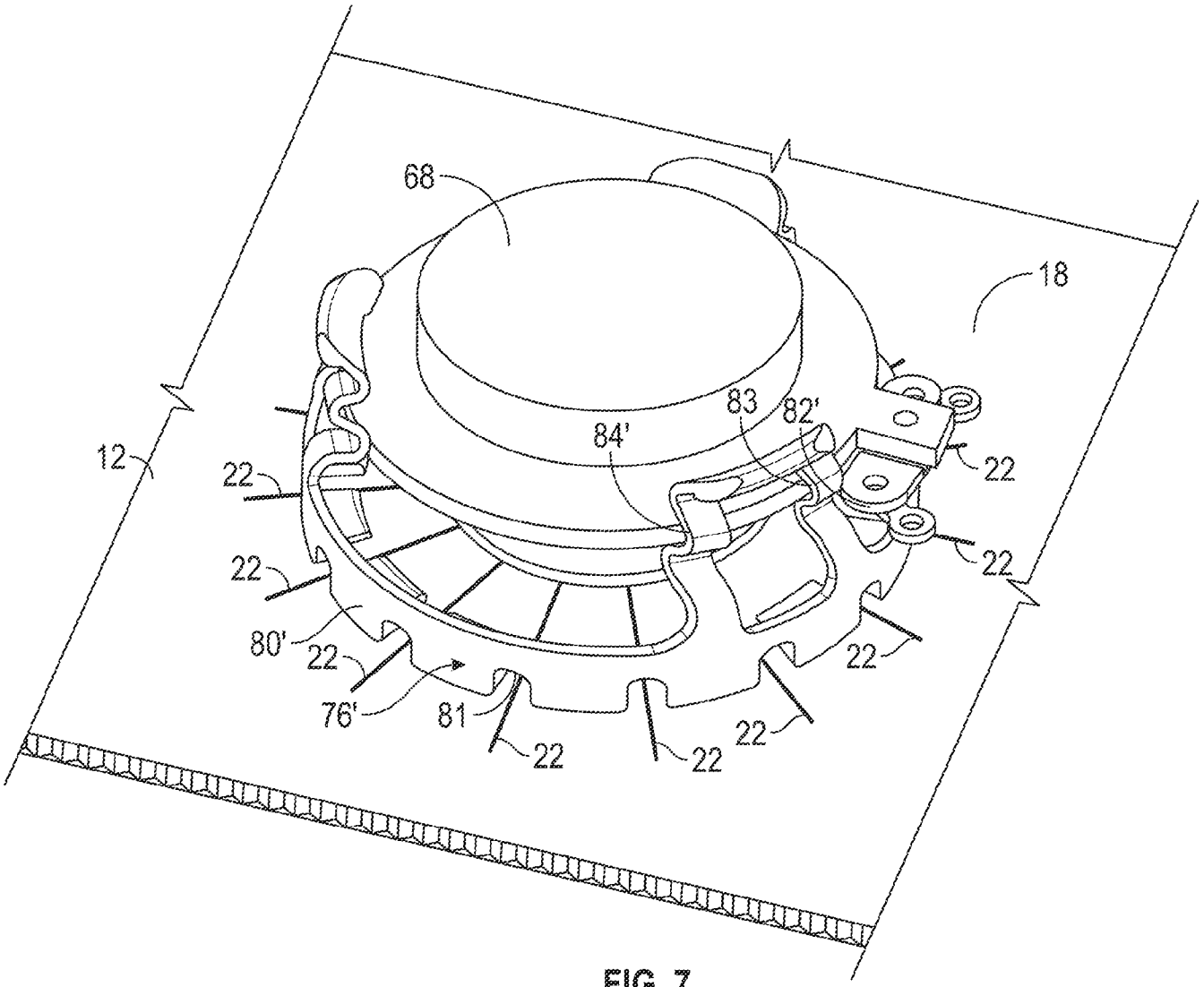
FIG. 7 is a perspective view of an alternate design of the exciter housing.

In an embodiment shown in FIG. 7, the exciter support bracket 76' may include a base 80' having cutouts 81 that may be shaped and positioned to avoid contact with the plurality of slots 22 formed in the outer sheet 18 of the panel 12. The cutouts 81 may reduce or prevent the exciter bracket 76' from interfering from the vibration of the panel 12. The arms 82' may include openings 83 that may reduce the spring value of the arms. In embodiments, the arms 82' may taper in thickness, increasing in thickness from the slots 84' to the base 80'. This tapering also may reduce the spring value of the arms 80' of the exciter housing 76'.

In operation, a method of constructing a flat panel loudspeaker system for transmitting sound energy within a vehicle cabin defined by the panel 12 may include forming the weakened area 20 (FIGS. 2 and 3) in the outer sheet 18 of the panel 12, in which the weakened area is defined by at least one slot 22 formed in the outer sheet. The slots 22 may be linear or curved in shape and formed by cutting, as by laser or router cutting, or abrading the material of the outer sheet 18. In other embodiments, the outer sheet 18 may be formed or cast with the slots 22 already present. The inner sheet 16 of the panel 12 (FIG. 1) may be formed to be imperforate over the weakened area 20.

The exciter 24 (FIGS. 1 and 4), may be attached to the panel 12 at the weakened area 20. In an embodiment, the annular base 58 of the lock base 56 may be attached to the panel 12 by an adhesive or other means, and in an embodiment, may be positioned so that it may be concentric with the center 28 (FIGS. 2 and 3) of the weakened area 20. The exciter support bracket 76 may be attached to the outer sheet 18 either before or after attaching the lock base 56 to the panel 12. In an embodiment, the exciter bracket 76 may be attached to the outer sheet 18 so that it may be centered relative to the center 28 of the weakened area 20, then the exciter housing 68, lock pad 44 and lock base 56 pressed downwardly (in FIG. 4) toward the sheet until the base 58 contacts the outer sheet and the flange 86 of the exciter housing engages and is retained in the slots 84 of the arms 82.

In embodiments, the lock base 56 may be attached to the panel 12 by itself, or as a unit along with the lock pad 44 and exciter housing 68. If the former, the lock pad 44 may thereafter be attached to the lock base 56 as shown in FIGS. 6A and 6B. The leads 88, 90 (FIG. 1) may be connected to a sound amplifier (not shown) and the sound amplifier provides a signal to the coil 42 of the exciter 24. The signal energizes the coil 42, and movement of the voice coil 40 causes the weakened area 20 to deflect. Thus, the exciter 24 vibrates the panel 12 at the weakened area 20 to generate sound energy within the vehicle cabin 26.

In an embodiment, the signal (which may be a sine wave) may be in the form of an electric current and voltage that energizes the coil 42, causing the coil to move in a direction perpendicular to the panel 12. This movement may be transmitted by the lock pad 44 to the lock base 56, and from the lock base directly to the outer sheet 18 of the panel 12, causing the panel 12 to flex and thus vibrate at the weakened area 20. In an embodiment, the signals may be representative of a human voice, so that the vibration of the panel 12 transmits sound energy to reproduce a human voice through the panel 12 and to the interior of the vehicle 26. Referring to FIG. 3, the quality of the sound produced by the system 10 may be altered and/or enhanced as needed by the addition of the damping element 36.

An advantage of the flat panel loudspeaker system 10 is that it may incorporate a panel 12 that is a current production base panel without need to make a specific custom layup formulation to act as the diaphragm of a speaker to transmit sound energy, including sound replicating a human voice, to the interior of a cabin defined by the panel. In embodiments, the pattern of slots 22 may be any suitable cut pattern that enables the panel 12 to vibrate a few nano-inches to produce audible sound waves. In an exemplary embodiment, the cut pattern may be a starburst pattern with intersecting cuts at the center 28 of the starburst. In embodiments, the cuts may be about 0.025 inches wide and may be formed by computer routing.

While the form of apparatus herein described constitutes a preferred embodiment of the disclosed flat panel loudspeaker system, it is to be understood that the flat panel loudspeaker system is not limited to this precise form of apparatus, and that changes may be made therein without departing from the scope of the claims.

What is claimed is:

1. An exciter assembly for use with a flat panel loudspeaker system, the loudspeaker system including a panel having a core, an inner sheet coupled to an inner surface of the core and an outer sheet coupled to an outer surface of the core, the exciter assembly comprising:

an exciter having an exciter housing, a voice coil assembly attachable to the outer sheet of the panel, the voice coil assembly having a lock pad, and a lock base releasably engaging the lock pad and attachable to the outer sheet of the panel, to vibrate the panel to generate sound energy;

the lock pad including a coil former and a cylindrical projection shaped to define a first opening;

the lock base including an annular base having a second opening coaxial with the first opening; and an exciter support bracket connected to the exciter housing and attachable to the outer sheet of the panel.

2. The exciter assembly of claim 1, wherein the voice coil assembly includes a coil that is energized by electric current.

3. The exciter assembly of claim 1, wherein the lock pad includes a coil former, the coil former including the voice coil assembly.

4. The exciter assembly of claim 3, wherein the coil former is mounted above the lock pad relative to the panel.

5. The exciter assembly of claim 4, wherein the coil former is cylindrical in shape.

6. The exciter assembly of claim 5, wherein the lock pad includes a cylindrical projection; and the coil former is sized to slip over the outer surface of the cylindrical projection of the lock pad.

7. The exciter assembly of claim 3, wherein the exciter includes a suspension spring attached at an inner periphery to the coil former and at an outer periphery to the exciter housing.

8. The exciter assembly of claim 1, wherein the lock pad includes a base having a plurality of radially projecting tabs.

9. The exciter assembly of claim 8, wherein the radially projecting tabs are spaced evenly about the base.

10. The exciter assembly of claim 8, wherein the lock base includes an outer flange having slots shaped to receive the plurality of tabs of the lock pad.

11. The exciter assembly of claim 10, wherein the slots include pockets for securing the tabs in a releasable friction fit.

12. The exciter assembly of claim 11, wherein the releasable friction fit is a bayonet connection.

13. The exciter assembly of claim 10, wherein at least one of the radially projecting tabs includes a raised locking detent; and at least one of the slots of the lock base includes a catch to engage the raised locking detent to prevent inadvertent disengagement of the lock pad from the lock base.

14. The exciter assembly of claim 1, wherein the lock base includes an annular base that contacts the outer sheet.

15. The exciter assembly of claim 1, wherein the exciter housing includes a magnet concentric with the coil.

16. The exciter assembly of claim 1, wherein the exciter support bracket includes a base mounted on the outer sheet of the panel.

17. The exciter assembly of claim 16, wherein the exciter support bracket includes a plurality of resilient arms projecting upwardly from the base of the support bracket relative to the panel.

18. The exciter assembly of claim 17, wherein the resilient arms form arcuate slots biased radially inwardly to releasably receive the exciter housing.

19. A flat panel loudspeaker system for a vehicle, the system comprising:

a panel forming a cabin wall in a vehicle, the panel having a core, an inner sheet coupled to an inner surface of the core and an outer sheet coupled to an outer surface of the core;

an exciter having an exciter housing, a voice coil assembly attached to the outer sheet of the panel, the voice coil assembly having a lock pad and a lock base releasably engaging the lock pad and mounted on and contacting the outer sheet of the panel, to vibrate the panel to generate sound energy within the vehicle; and the lock pad including a coil former and a cylindrical projection shaped to define a first opening;

the lock base mounted on and contacting the outer sheet of the panel and including an annular base having a second opening coaxial with the first opening; and an exciter support bracket connected to the exciter housing and attached to the outer sheet.

20. A method of constructing a flat panel loudspeaker system for transmitting sound energy within a vehicle cabin including a panel, the panel having a core, an inner sheet coupled to an inner surface of the core, and an outer sheet coupled to an outer surface of the core, the method comprising:

attaching an exciter having an exciter housing, a voice coil assembly to the outer sheet of the panel, the voice coil assembly having a lock pad including a coil former and a cylindrical projection shaped to define a first opening, and a lock base including an annular base having a second opening coaxial with the first opening, by attaching the annular base of the lock pad to the outer sheet of the panel, and releasably attaching the lock pad to the lock base, such that vibration of the exciter vibrates the panel to generate sound energy within the vehicle cabin;

attaching an exciter support bracket to the outer sheet; and connecting the exciter support bracket to the exciter housing.

* * * * *